US010265950B2

(12) United States Patent
Nagane

(10) Patent No.: US 10,265,950 B2
(45) Date of Patent: Apr. 23, 2019

(54) INKJET HEAD CONTROL APPARATUS AND INKJET PRINTER

(71) Applicant: TOSHIBA TEC KABUSHIKI KAISHA, Tokyo (JP)

(72) Inventor: Ryuta Nagane, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/928,632

(22) Filed: Mar. 22, 2018

(65) Prior Publication Data

US 2018/0272701 A1 Sep. 27, 2018

(30) Foreign Application Priority Data

Mar. 24, 2017 (JP) ..... 2017-059868

(51) Int. Cl.
*B41J 2/045* (2006.01)
*B41J 2/14* (2006.01)

(52) U.S. Cl.
CPC ..... *B41J 2/04541* (2013.01); *B41J 2/04543* (2013.01); *B41J 2/04548* (2013.01); *B41J 2/04551* (2013.01); *B41J 2/04581* (2013.01); *B41J 2/14201* (2013.01); *B41J 2002/14491* (2013.01); *B41J 2202/13* (2013.01)

(58) Field of Classification Search
CPC ..... B41J 2/04548
See application file for complete search history.

(56) References Cited

U.S. PATENT DOCUMENTS

2005/0237354 A1* 10/2005 Quintana ..... B41J 2/04541 347/12
2013/0016144 A1* 1/2013 Teranishi ..... B41J 19/005 347/9
2016/0368265 A1* 12/2016 Dipert ..... B41J 2/04541
2018/0050538 A1* 2/2018 Dipert ..... B41J 2/35
2018/0079205 A1* 3/2018 Yamashita ..... B41J 2/04541

FOREIGN PATENT DOCUMENTS

EP 0783967 A2 * 7/1997 ..... B41J 2/04541
JP H10-193708 A 7/1998
JP 2009-113325 A 5/2009
JP 2016-028882 A 3/2016

* cited by examiner

*Primary Examiner* — Shelby L Fidler
(74) *Attorney, Agent, or Firm* — Kim & Stewart LLP

(57) ABSTRACT

An inkjet head control apparatus includes a mother substrate, a plurality of daughter substrates connected to a plurality of connectors of the mother substrate, each daughter substrate having a different built-in address, and a communication circuit on the mother substrate and configured to select an address of one of the plurality of daughter substrates, and transmit a control signal including the selected address and information for controlling power supply to an inkjet head to the plurality of connectors. Each of the plurality of daughter substrates includes a determination circuit configured to determine whether or not the selected address corresponds to the built-in address of the daughter substrate, and a voltage generating circuit configured to generate a direct current (DC) voltage for driving the inkjet head based on the control signal when it is determined that the selected address corresponds to the built-in address.

20 Claims, 2 Drawing Sheets

INKJET HEAD CONTROL APPARATUS AND INKJET PRINTER

CROSS-REFERENCE TO RELATED APPLICATION

This application is based upon and claims the benefit of priority from Japanese Patent Application No. 2017-059868, filed Mar. 24, 2017, the entire contents of which are incorporated herein by reference.

FIELD

Embodiments described herein relate generally to an inkjet head control apparatus and an inkjet printer.

BACKGROUND

An inkjet printer has been widely used for printing a pattern according to printing data from a host computer or the like. The inkjet printer generally includes an inkjet head and an inkjet head control apparatus (also referred to as an inkjet head control circuit) for controlling the inkjet head. The inkjet head control apparatus supplies image data and a direct current (DC) voltage to the inkjet head based on printing data a host computer. The inkjet head drives an actuator for discharging ink based on the image data and the DC voltage to form an image on a printing medium.

An inkjet printer may include multiple inkjet heads having different numbers of ink discharging rows, for example, for single-color printing and multi-color printing. For an inkjet printer having multiple inkjet heads, an inkjet head control apparatus is required for each inkjet head. Therefore, there is a need for an inkjet printer having multiple inkjet head control apparatuses.

DETAILED DESCRIPTION

An inkjet head control apparatus includes a mother substrate having a plurality of connectors, a plurality of daughter substrates connected to the plurality of connectors of the mother substrate, each daughter substrate having a different built-in address, and a communication circuit on the mother substrate and configured to select an address of one of the plurality of daughter substrates connected to one of the plurality of connectors, and transmit a control signal including the selected address and information for controlling power supply to an inkjet head to the plurality of connectors. Each of the plurality of daughter substrates includes a determination circuit configured to determine whether or not the selected address included in the control signal corresponds to the built-in address of the daughter substrate, and a voltage generating circuit configured to generate a direct current (DC) voltage for driving the inkjet head based on the control signal when it is determined by the determination circuit that the selected address included in the control signal corresponds to the built-in address.

Hereinafter, an inkjet head control apparatus and an inkjet printer according to one embodiment will be described with reference to the drawings.

Figure 1:
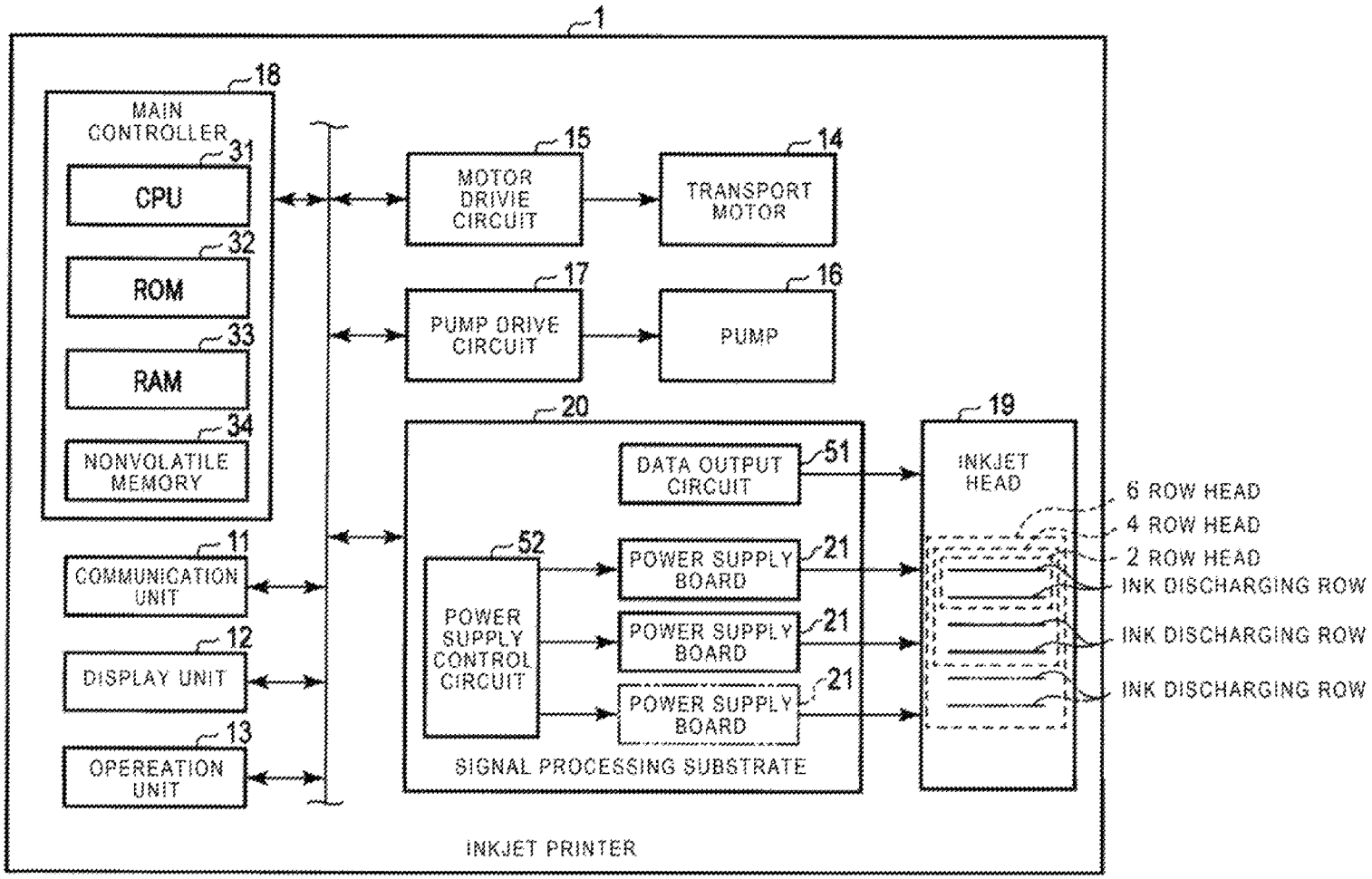
FIG. 1 is a view of an inkjet printer according to one embodiment.
Figure 2:
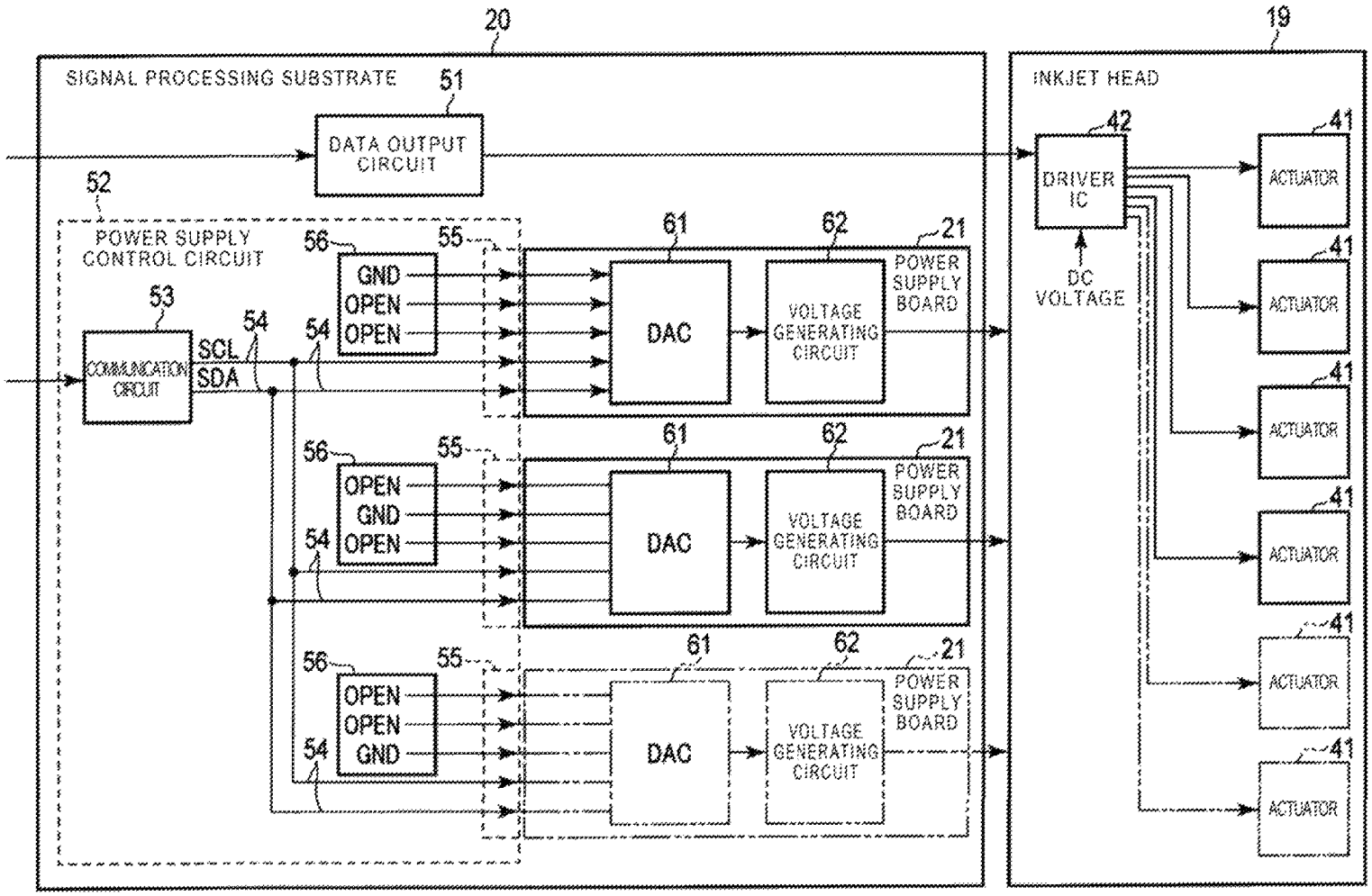
FIG. 2 is an enlarged view of an inkjet head according to one embodiment.

First, the inkjet printer 1 according to one embodiment will be described. FIG. 1 is a view of a configuration example of the inkjet printer 1 according to one embodiment. FIG. 2 is an enlarged view of a configuration example of the inkjet printer 1 according to one embodiment. The inkjet printer is one example of an inkjet recording apparatus.

The inkjet printer 1 receives printing data from a host personal computer (PC). The host PC is, for example, an electronic device on which a program (printer driver) having a printing function is installed. By executing the printer driver, the host PC inputs the printing data and the command for changing the setting of the inkjet printer 1 into the inkjet printer 1.

The inkjet printer 1 forms an image on a printing media such as paper according to printing data while transporting the printing medium. The inkjet printer 1 is, for example, a printer that forms images on the printing medium by an inkjet method. The inkjet printer performs a printing of forming an image on the printing medium based on printing data input from the host PC.

The inkjet printer 1 includes a communication unit 11, a display unit 12, an operation unit 13, a transport motor 14, a motor drive circuit 15, a pump 16, a pump drive circuit 17, a main controller 18, an inkjet head 19, a signal processing substrate 20, and one or more power supply boards 21. FIG. 2 shows an example of a detailed configuration of the inkjet head 19, the signal processing substrate 20, and power supply boards 21.

The communication unit 11 is an interface for communicating with other devices. The communication unit 11 is used for communication with, for example, the host PC that is the host device that transmits printing data to the inkjet printer 1. The communication unit 11 may wirelessly communicate with other device according to a standard such as Bluetooth® or Wi-Fi®.

The display unit 12 is a display device that displays a screen according to a video signal input from the main controller 18 or display controller such as a graphic controller (not specifically shown). For example, on the display unit 12 a screen for setting the inkjet printer 1 is displayed.

The operation unit 13 generates an instruction signal based on the operation of an input device. For example, the input device is a touch sensor, a ten key, a power key, a paper feed key, various function keys, a keyboard, or the like. The touch sensor is, for example, a resistive touch sensor, a capacitive touch sensor, or the like. The touch sensor acquires information indicating a designated position on the screen. The touch sensor is integrated with the display unit 12 to form a touch panel, which allows a signal indicating the touched position of the screen displayed on the display unit 12 to be input to the main controller 18.

The transport motor 14 operates a transport mechanism in a transport path (not specifically shown) for transporting recording paper (also referred to as printing medium) by rotating. The transport mechanism is, for example, a belt, a roller, a guide, or the like for transporting recording paper. The transport motor 14 transports recording paper along the guide by rotating the roller that operates in conjunction with the belt that holds recording paper.

The motor drive circuit 15 is a circuit for driving the transport motor 14. The motor drive circuit 15 drives the transport motor 14 under the control of the main controller 18 to transport the recording paper of a paper feed cassette to a paper discharge tray through the inkjet head 19. The paper feed cassette is a cassette for storing a plurality of recording papers. The paper discharge tray accommodates the recording paper on which an image has been formed by the inkjet printer 1 and which has been discharged.

The pump 16 includes, for example, a tube that communicates with an ink tank (not shown) holding ink and the inkjet head 19. More specifically, the tube communicates with a common liquid chamber (not shown) of the inkjet head 19.

The pump drive circuit 17 drives the pump 16 under the control of the main controller 18 to supply the ink in the ink tank to the common liquid chamber of the inkjet head 19.

The main controller 18 controls the inkjet printer 1. The main controller 18 includes a Central Processing Unit (CPU) 31, a Read Only Memory (ROM) 32, a Random Access Memory (RAM) 33, and a nonvolatile memory 34.

The CPU 31 includes an arithmetic element (for example, a processor) that executes arithmetic processing. The CPU 31 performs various processes based on data such as programs stored in the ROM 32. The CPU 31 executes the program stored in the ROM 32 to allow the CPU 31 to function as a controller capable of executing various operations. For example, the CPU 31 controls the operation of the motor drive circuit 15, controls the operation of the pump drive circuit 17, and generates image data to be input to the inkjet head 19. The CPU 31 acquires printing data from the host PC. The CPU 31 generates image data based on the printing data and develops the image data on the RAM 33.

The ROM 32 is a read-only nonvolatile memory. The ROM 32 stores programs, data used in programs, or the like.

The RAM 33 is a volatile memory that functions as a working memory. The RAM 33 temporarily stores data under processing of the CPU 31 and the like. Further, the RAM 33 temporarily stores programs executed by the CPU 31.

The nonvolatile memory 34 is a storage medium capable of storing various information. The nonvolatile memory 34 stores programs, data used in programs, or the like. The nonvolatile memory 34 is, for example, a solid state drive (SSD), a hard disk drive (HDD), or other storage device. Instead of the nonvolatile memory 34, a memory interface (I/F) such as a card slot into which a storage medium such as a memory card can be inserted may be provided.

The inkjet head 19 is an image forming portion for forming an image on the recording paper. The inkjet head 19 forms an image on the recording paper by discharging ink onto the recording paper held by a holding roller (not specifically shown). The inkjet head 19 may be configured to correspond to a single color ink such as black, or may be configured to correspond to inks of a plurality of colors such as cyan, magenta, yellow, and black. As shown in FIG. 2, the inkjet head 19 includes an actuator 41 and a driver IC 42.

The actuator 41 is a piezoelectric element of which the shape is changed depending on an applied voltage to change the pressure of the ink liquid chamber filled with ink. The actuator 41 is driven by the voltage input from the driver IC 42. When the pressure in a pressure chamber becomes low through the driving of the actuator 41, the ink is drawn from a common chamber of the ink liquid chamber into the pressure chamber of the ink liquid chamber. Further, when the pressure in a pressure chamber of the ink liquid chamber becomes high through the driving of the actuator 41, the ink in the pressure chamber of the ink liquid chamber is discharged from a nozzle provided in the ink liquid chamber.

The ink liquid chamber is a space filled with ink. The ink liquid chamber includes the common liquid chamber, and the pressure chamber partitioned by the actuator 41 for each nozzle. The common liquid chamber is filled with the ink supplied from the ink tank. The pressure of the pressure chamber is controlled by the actuator 41.

The nozzle is a hole through which ink in the pressure chamber is discharged. The nozzles are arranged in a line shape. Further, the pressure chamber and the actuators 41 corresponding to the pressure chambers are disposed in a line along the direction in which the nozzles are arranged. The inkjet head 19 includes a plurality of ink discharging rows, each of which is formed with the actuators and the nozzles arranged in the line shape.

The driver IC 42 drives the actuators 41 by applying a potential to the electrode of the actuator 41. The driver IC 42 drives the actuators 41 for each ink discharging line. The driver IC 42 drives the actuators 41 based on control of an inkjet head control apparatus. Specifically, the driver IC 42 acquires image data from the signal processing substrate 20. Further, the driver IC 42 receives the supply of the DC voltage from the power supply board 21. The driver IC 42 generates a drive signal for driving the actuators 41 based on the DC voltage supplied from the power supply board 21 and the image data acquired from the signal processing substrate 20. The driver IC 42 drives the actuators by inputting the drive signal to the actuators 41.

For example, the inkjet head 19 has three partial heads, having two ink discharging rows, four ink discharging rows, and six ink discharging rows, respectively. The inkjet head 19 having two ink discharging rows (referred to as a 2-row head) performs formation of images at a high resolution, for example, by discharging one color ink from the two ink discharging rows. The inkjet head 19 having four ink discharging rows (referred to as a four-row head) performs formation of images with one to four colors, for example, by discharging inks of different colors for each ink discharging row. The inkjet head 19 having six ink discharging rows (referred to as a six-row head) performs formation of images with one to six colors, for example, by discharging inks of different colors for each ink discharging row. The driver IC 42 may be provided for each ink discharging row or may be provided for each of a plurality of ink discharging rows. Further, one driver IC 42 may drive all actuators 41 of the ink discharging row.

The signal processing substrate 20 is a substrate on which is mounted a circuit for transmitting data to the inkjet head 19, a circuit for controlling power supply to the inkjet head 19, and the like. The signal processing substrate 20 functions as a mother substrate to which a power supply board 21 as a daughter substrate is connected. Further, the signal processing substrate 20 is also connected to the inkjet head 19. The signal processing substrate 20 functions as the inkjet head control apparatus that controls the operation of the inkjet head 19 by being combined with the power supply boards 21. More specifically, the power supply boards 21 as one to three daughter substrates are mounted on and connected to the signal processing substrate 20 as the mother substrate, whereby the inkjet head control apparatus that controls the operation of the inkjet head 19 is constituted.

As shown in FIG. 2, the signal processing substrate 20 includes a data output circuit 51 and a power supply control circuit 52. In FIG. 2, the inkjet head 19 is the 4-row head and two power supply boards 21 are connected to the signal processing substrate 20.

The data output circuit 51 is a circuit for outputting image data developed in a page memory area of RAM 33 by the CPU 31 to the inkjet head 19 by DMA transfer control. The data output circuit 51 outputs the image data to the inkjet head 19 at a transfer rate corresponding to a printing frequency in the inkjet head 19.

The power supply control circuit 52 is a circuit for controlling power supply to the inkjet head 19. The power supply control circuit 52 controls at least one circuit of the power supply boards 21 connected to the signal processing substrate 20. As shown in FIG. 2, the power supply control circuit 52 includes a communication circuit 53, a common bus 54, a plurality of connectors 55, and a plurality of address circuits 56. In the example embodiments described herein, the power supply control circuit 52 includes three connectors 55 and three address circuits 56.

The communication circuit 53 is a circuit for transmitting a control signal to the power supply boards 21 connected to the plurality of connectors 55 for controlling power supply to the inkjet head 19. The communication circuit 53, for example, generates a digital control signal under the control of the CPU 31 and transmits the generated signal to the power supply boards 21. In addition, the communication circuit 53 for example, may receive a digital control signal generated by the CPU 31 from the CPU 31 and transmit the received signal to the power supply boards 21.

The communication circuit 53 transmits a control signal to the power supply boards 21 by, for example, Inter-Integrated Circuit (I2C) communication. The communication circuit 53 functions as a master in the I2C communication.

The I2C communication is a serial communication system that is divided into a master side and a slave side, where a master can transmit data to a plurality of slaves. In the i2C communication, the master side and the slave side are connected to each other in a form of a party line by a serial clock line (SCL) and a serial data line (SDA). That is, a terminal, to which the SCL and the SDA of the master are connected, is connected to a terminal, to which the SCL and the SDA of the plurality of slaves are connected, through a common SCL and a common SDA.

The master transmits a clock signal by the SCL and transmits data by the SDA. In the I2C communication, the master side selects an address assigned to one of the plurality of slaves and transmits data including the selected address by the SCL and the SDA. In this way, the plurality of slaves receive data transmitted from the master side, and performs processing according to the received data when the selected address included in the received data matches a slave's own built-in address.

The communication circuit 53 generates a control signal including a selected address and a voltage value of a DC voltage supplied from the power supply boards 21 to the inkjet head 19 as information. The communication circuit 53 transmits the generated control signal to the circuits connected to the connector 55 through the common bus 54.

The common bus 54 is a signal line that connects the communication circuit 53 and the connectors 55 to each other. The common bus 54 connects one communication circuit 53 and the plurality of connectors 55 with a common signal line. The common bus 54 is formed with, for example, two signal lines. Specifically, the two signal lines of the common bus 54 are the SCL and the SDA.

The connectors 55 are circuits and connection portions to which the power supply boards 21 are connected. The connector 55 includes, for example, two signal lines constituting the common bus 54 and three signal lines connected to the address circuit 56. In each of the plurality of connectors 55, a different built-in address is set by the address circuit 56.

The address circuit 56 allows each of three signal lines to be connected to the connector 55 in a grounded state (GND) or an open state (OPEN). The address circuit 56 includes, for example, a dip switch that switches the signal line between GND and OPEN. The address circuit 56 allows the three signal lines to be connected in different open or grounded states by combining the three signal lines to different open or grounded states depending on the connector 55 to be connected. In FIG. 2, the three signal lines of the three address circuits 56 that are connected to different connectors 55 are connected in a combination of GND-OPEN-OPEN, a combination of OPEN-GND-OPEN, and a combination of OPEN-OPEN-GND, respectively. The plurality of address circuits 56 are designed such that, when the respective three signal lines of the address circuits 56 are connected to the connector 55, the combinations of the plurality of signal lines with the grounded state and the open states are not provided to be different from each other on the signal processing substrate 20. The address circuit 56 supplies addresses corresponding to the combinations of the plurality of signal lines to the grounded state and the open state to the power supply boards 21.

The power supply board 21 generates a DC voltage according to the specification of the inkjet head 19 based on alternating current power supplied from a commercial power supply (not specifically shown), and supplies the generated the DC voltage to the inkjet head 19. The power supply board 21 functions as the daughter substrate connected to the signal processing substrate 20 as the mother substrate. That is, the communication circuit 53 functions as the master in the I2C communication. For example, one power supply board 21 drives two rows of a plurality of ink discharging rows of the inkjet head 19.

As shown in FIG. 2, the power supply board 21 includes a digital to analog converter (DAC) 61 and a voltage generating circuit 62.

The DAC 61 converts a digital control signal, which is supplied from the signal processing substrate 20 to which the power supply board 21 is connected, into an analog control signal, and supplies the analog control signal to the voltage generating circuit 62. The DAC 61 includes three terminals for acquiring built-in addresses (referred to as address acquisition terminals), two terminals into which the control signal is input (referred to as control signal input terminals), and one terminal connected to the voltage generating circuit 62 (referred to as an output terminal).

The three signal lines connected to the address acquisition terminal are pulled up to a predetermined potential through a resistance on the power supply board 21. When the power supply board 21 is connected to the signal processing substrate 20, the address acquisition terminal is connected to the address circuit 56 of the power supply control circuit 52 of the signal processing substrate 20. The DAC 61 acquires the built-in address of the connector 55 to which the power supply board 21 is connected by detecting the potential of the address acquisition terminal. Specifically, the DAC 61 acquires the potential of the address acquisition terminal as a logical value, and handles the acquired logical value as the built-in address.

When the power supply board 21 is connected to the signal processing substrate 20, the two signal lines connected to the control signal input terminal are connected to the communication circuit 53 of the power supply control circuit 52 of the signal processing substrate 20 through the common bus 54. That is, when the power supply board 21 is connected to the signal processing substrate 20, the control signal input terminal is connected to the communication circuit 53 of the signal processing substrate 20 through the SCL and the SDA which are the common bus 54. The DAC 61 acquires the digital control signal transmitted from the communication circuit 53 by detecting the potential of the control signal input terminal.

Further, the DAC 61 compares the selected address included in the acquired digital control signal with the built-in address acquired by the address acquisition terminal. That is, the DAC 61 functions as a determination circuit for determining whether or not the selected address match the built-in address.

When the selected address included in the acquired digital control signal matches the built-in address acquired by the address acquisition terminal, the DAC 61 performs digital/analog conversion on the control signal to generate an analog control signal. The DAC 61 outputs the analog control signal from the output signal. Specifically, the DAC 61 converts the control signal into a digital signal to thereby generate a signal having a voltage value included in the control signal. The DAC 61 supplies the generated control signal to the voltage generating circuit 62 as a reference voltage. When the selected address included in the acquired digital control signal does not match the built-in address acquired by the address acquisition terminal, the DAC 61 does not alter a voltage of the output terminal.

The voltage generating circuit 62 generates a DC voltage of a value corresponding to an analog control signal supplied from the DAC 61 based on the AC power supplied from the commercial power supply (not specifically shown), and supplies the DC voltage to the inkjet head 19.

As described above, the signal processing substrate 20 functioning as a part of the inkjet head control apparatus includes the plurality of connectors for connecting daughter substrates for which different built-in addresses are set, and the common bus 54 connected to the plurality of connectors. The communication circuit 53 of the power supply control circuit 52 of the signal processing substrate 20 transmits the control signal including a selected address for controlling power supply to the inkjet head 19 to the common bus 54. In this way, the communication circuit 53 transmits the control signal to the power supply boards 21 as the daughter substrate connected to the plurality of connectors 55.

When the DAC 61 of the power supply board 21 functioning as a part of the inkjet head control apparatus is connected to the signal processing substrate 20 as the mother substrate, the DAC 61 recognizes the DAC 61's own built-in address by acquiring the built-in address set in the connector 55 of the mother substrate. That is, since different built-in addresses are set for the plurality of connectors of the mother substrate, even if daughter substrates of the same specification are connected to the mother substrate, different built-in addresses are allocated to the plurality of daughter substrates. Furthermore, determination is made whether or not the selected address included in the control signal transmitted from the mother substrate matches the daughter substrate's own built-in address. When it is determined that the selected address included in the control signal transmitted from the mother substrate matches the daughter substrate's own address, the voltage generating circuit 62 of the power supply board 21 outputs a DC voltage for driving the inkjet head 19 to the inkjet head 19 based on the control signal.

According to the example embodiments described above, depending on whether or not the power supply board 21 is included, the power supply board 21 determines whether or not to perform processing based on the received control signal. In this way, even when a plurality of power supply boards 21 (having the same configuration) are connected to the common bus 54 of the signal processing substrate 20, which serves as the mother substrate, each power supply board 21 determines whether or not the control signal supplied from the signal processing substrate 20 is information specifically addressed to the power supply board 21 itself and performs processing according to information. In addition, even if daughter substrates are inserted in any positions of the connectors 55, it is still possible to perform processing. As a result, versatility of the power supply board 21 can be improved.

According to the signal processing substrate 20 and the power supply boards 21, connecting one power supply board 21 to the signal processing substrate 20 makes it possible to drive an inkjet head 19 having two ink discharging rows. In addition, connecting two power supply boards 21 to the signal processing substrate 20 makes it possible to drive an inkjet head 19 having four ink discharging rows. Furthermore, connecting three power supply boards 21 to the signal processing substrate 20 makes it possible to drive an inkjet head 19 having six ink discharging rows. In this way, the inkjet head control apparatus according to the example embodiments described above can employ a plurality of kinds of inkjet heads depending on the number of the power supply boards 21 connected to the signal processing substrate 20.

While certain embodiments have been described, these embodiments have been presented by way of example only, and are not intended to limit the scope of the inventions. Indeed, the novel embodiment described herein may be embodied in a variety of other forms. Furthermore, various omissions, substitutions and changes in the form of the embodiment described herein maybe made without departing from the spirit of the invention. The accompanying claims and their equivalents are intended to cover such forms or modifications as would fall within the scope and spirit of the invention.

What is claimed is:

1. An inkjet head control apparatus, comprising:

a mother substrate having a plurality of connectors;

a plurality of daughter substrates connected to the plurality of connectors of the mother substrate, each daughter substrate having a different built-in address; and a communication circuit on the mother substrate and configured to:

select an address of one of the plurality of daughter substrates connected to one of the plurality of connectors, and transmit a control signal including the selected address and information for controlling power supply to an inkjet head to the plurality of connectors, wherein each of the plurality of daughter substrates includes:

a determination circuit configured to determine whether or not the selected address included in the control signal corresponds to the built-in address of the daughter substrate; and a voltage generating circuit configured to generate a direct current (DC) voltage for driving the inkjet head based on the control signal when it is determined by the determination circuit that the selected address included in the control signal corresponds to the built-in address.

2. The apparatus of claim 1, wherein the voltage generating circuit generates the DC voltage based on a voltage value included in the control signal.

3. The apparatus of claim 1, wherein each of the plurality of connectors includes a plurality of signal lines, each of which can be set in a grounded state or an open state, and the selected address included in the control signal is supplied as a particular combination of grounded state and the open state signal lines in the plurality of signal lines.

4. The apparatus of claim 1, further comprising:

an inter-integrated circuit (I2C) bus on the mother substrate and connecting the communication circuit and the plurality of connectors.

5. The apparatus of claim 1, further comprising:

a data output circuit on the mother substrate and configured to output image data to the inkjet head to be printed.

6. An inkjet printer, comprising:

an inkjet head that forms an image on a printing medium;

a mother substrate having a plurality of connectors;

a plurality of daughter substrates connected to the plurality of connectors of the mother substrate, each daughter substrate having a different built-in address; and a communication circuit on the mother substrate and configured to:

select an address of one of the plurality of daughter substrates connected to one of the plurality of connectors, and transmit a control signal including the selected address and information for controlling power supply to the inkjet head to the plurality of connectors, wherein each of the plurality of daughter substrates includes:

a determination circuit configured to determine whether or not the selected address included in the control signal corresponds to the built-in address of the daughter substrate; and a voltage generating circuit configured to generate a direct current (DC) voltage for driving the inkjet head based on the control signal when it is determined by the determination circuit that the selected address included in the control signal corresponds to the built-in address.

7. The inkjet printer according to claim 6, wherein the inkjet head includes a plurality of partial heads, each of the plurality of partial heads including a different number of ink discharging rows and connecting to one respective daughter substrate of the plurality of daughter substrates, each ink discharging row comprises nozzles aligned in a line.

8. The inkjet printer according to claim 7, wherein the generation circuit of each of the plurality of daughter substrates generate a voltage to drive one of the plurality of partial heads.

9. The inkjet printer according to claim 6, wherein the voltage generating circuit generates the DC voltage based on a voltage value included in the control signal.

10. The inkjet printer according to claim 6, wherein each of the plurality of connectors includes a plurality of signal lines, each of which can be set in a grounded state or an open state, and the selected address included in the control signal is supplied as a particular combination of grounded state and the open state signal lines in the plurality of signal lines.

11. The inkjet printer according to claim 6, further comprising:

an inter-integrated circuit (I2C) bus on the mother substrate and connecting the communication circuit and the plurality of connectors.

12. The inkjet printer according to claim 6, further comprising:

a data output circuit on the mother substrate and configured to output image data to the inkjet head to be printed.

13. An inkjet head control apparatus, comprising:

a mother substrate having a first connector and a second connector;

a first daughter substrate connected to the first connector of the mother substrate and having a first built-in address;

a second daughter substrate connected to the second connector of the mother substrate and having a second built-in address;

a communication circuit on the mother substrate and configured to select one of the first and second built-in addresses, and transmit a control signal including the selected one of the first and second built-in addresses and information for controlling a power supply of an inkjet head to the first and second connectors, wherein each of the first and second daughter substrates includes:

a determination circuit configured to determine whether or not the control signal includes an address matching the respective built-in address; and a voltage generating circuit configured to generate a direct current (DC) voltage for driving the inkjet head based on the control signal when it is determined by the determination circuit that the address included in the control signal matches the built-in address.

14. The inkjet head control apparatus according to claim 13, further comprising:

a third daughter substrate connected to the mother substrate, the third daughter substrate having a third built-in address, wherein the mother substrate further includes:

a third connector for connecting the third daughter substrate; and the communication circuit is further configured to select one of the first, second, and third built-in addresses to be included in the control signal as the selected address.

15. The inkjet head control apparatus according to claim 14, wherein the inkjet head includes a plurality of partial heads, each of the plurality of partial heads including a different number of ink discharging rows and connecting to one respective daughter substrate of the plurality of daughter substrates, each ink discharging row comprises nozzles aligned in a line.

16. The inkjet head control apparatus according to claim 15, wherein the generation circuit of each of the plurality of daughter substrates generates a voltage to drive.

17. The inkjet head control apparatus according to claim 13, wherein the voltage generating circuit generates the DC voltage based on a voltage value included in the control signal.

18. The inkjet head control apparatus according to claim 13, wherein each of the plurality of connectors includes a plurality of signal lines, each of which can be set in a grounded state or an open state, and the selected address included in the control signal is supplied as a particular combination of grounded state and the open state signal lines in the plurality of signal lines.

19. The inkjet head control apparatus according to claim 13, further comprising:

an inter-integrated circuit (I2C) bus on the mother substrate and connecting the communication circuit and the plurality of connectors.

20. The inkjet head control apparatus according to claim 13, further comprising:

a data output circuit on the mother substrate and configured to output image data to the inkjet head to be printed.

* * * * *